US005303911A

United States Patent [19]

Zahn et al.

[11] Patent Number: 5,303,911

[45] Date of Patent: Apr. 19, 1994

[54] DEVICE FOR UNITING A RESIDUAL PILE OF SHEETS AND A MAIN PILE OF SHEETS

[75] Inventors: Erich M. Zahn, Eppelheim; Gerhard Pollich, Heidelberg, both of Fed. Rep. of Germany

[73] Assignee: Heidelberger Druckmaschinen AG, Heidelberg, Fed. Rep. of Germany

[21] Appl. No.: 939,452

[22] Filed: Sep. 2, 1992

[30] Foreign Application Priority Data

Sep. 2, 1991 [DE] Fed. Rep. of Germany ..... 4129139

[51] Int. Cl.[5] ..... B65H 1/30

[52] U.S. Cl. ..... 271/158; 414/795.8

[58] Field of Search ..... 271/157-159; 414/795.8

[56] References Cited

U.S. PATENT DOCUMENTS

| | | | |
|---|---|---|---|
| 3,180,638 | 4/1965 | Meylan | 271/159 |
| 5,011,126 | 4/1991 | Suzuki et al. | 271/159 |
| 5,096,372 | 3/1992 | Haejima | 271/158 |
| 5,116,041 | 5/1992 | Pollich | 271/158 |

FOREIGN PATENT DOCUMENTS

| | | | |
|---|---|---|---|
| 1095297 | 12/1960 | Fed. Rep. of Germany | 271/159 |
| 3922803 | 1/1990 | Fed. Rep. of Germany . | |
| 1321222 | 12/1989 | Japan . | |
| 3-9333 | 1/1991 | Japan . | |
| 4-041337 | 2/1992 | Japan | 271/158 |
| 353020 | 5/1961 | Sweden | 271/158 |

*Primary Examiner*—H. Grant Skaggs

*Attorney, Agent, or Firm*—Herbert L. Lerner; Laurence A. Greenberg

[57] ABSTRACT

A device for uniting a residual and a main pile of sheets in a pile zone of a sheet feeder to form an aggregate pile wherein an uppermost sheet of the main pile has been brought into contact with a lowermost sheet of the residual pile, includes a rake for underpinning and carrying the residual pile during given phases of a process for uniting the piles, the rake having mutually parallel, horizontal lattice bars. Also included are a displacement device for carrying and displacing the rake, horizontally in longitudinal direction of the lattice bars between a first position outside the pile zone and a second position inside the pile zone, wherein the residual pile is underpinned by the rake, a device disposed in the pile zone for supporting respective ends of the lattice bars projecting beyond the residual pile, and a lifting device carrying the displacement device for lowering the rake into a lower position and for raising the rake into an upper position. The lifting device has a horizontally disposed cross-member arrangement holding the displacement device and being oriented transversely to the lattice bars, and a lifting cradle having vertically extending guideways, a first and a second end of the cross-member arrangement being guidable by the guideways. The lifting cradle is constituted by a gantry disposed outside the pile zone, and includes a pair of columns respectively formed of a hollow section, and a compensation device including a respective counterweight dipping into the hollow section.

3 Claims, 12 Drawing Sheets

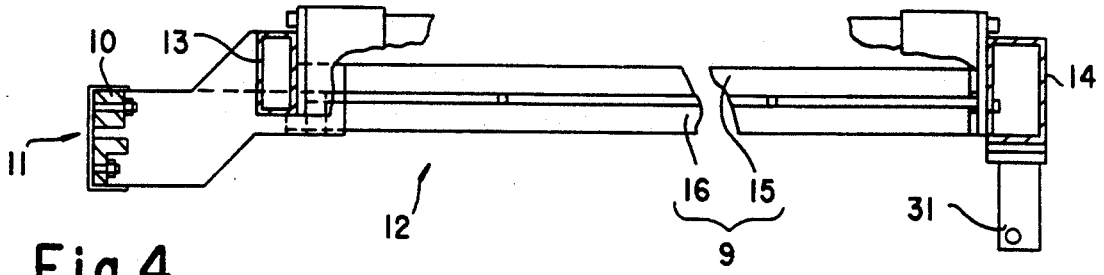
Fig.4
Fig.3
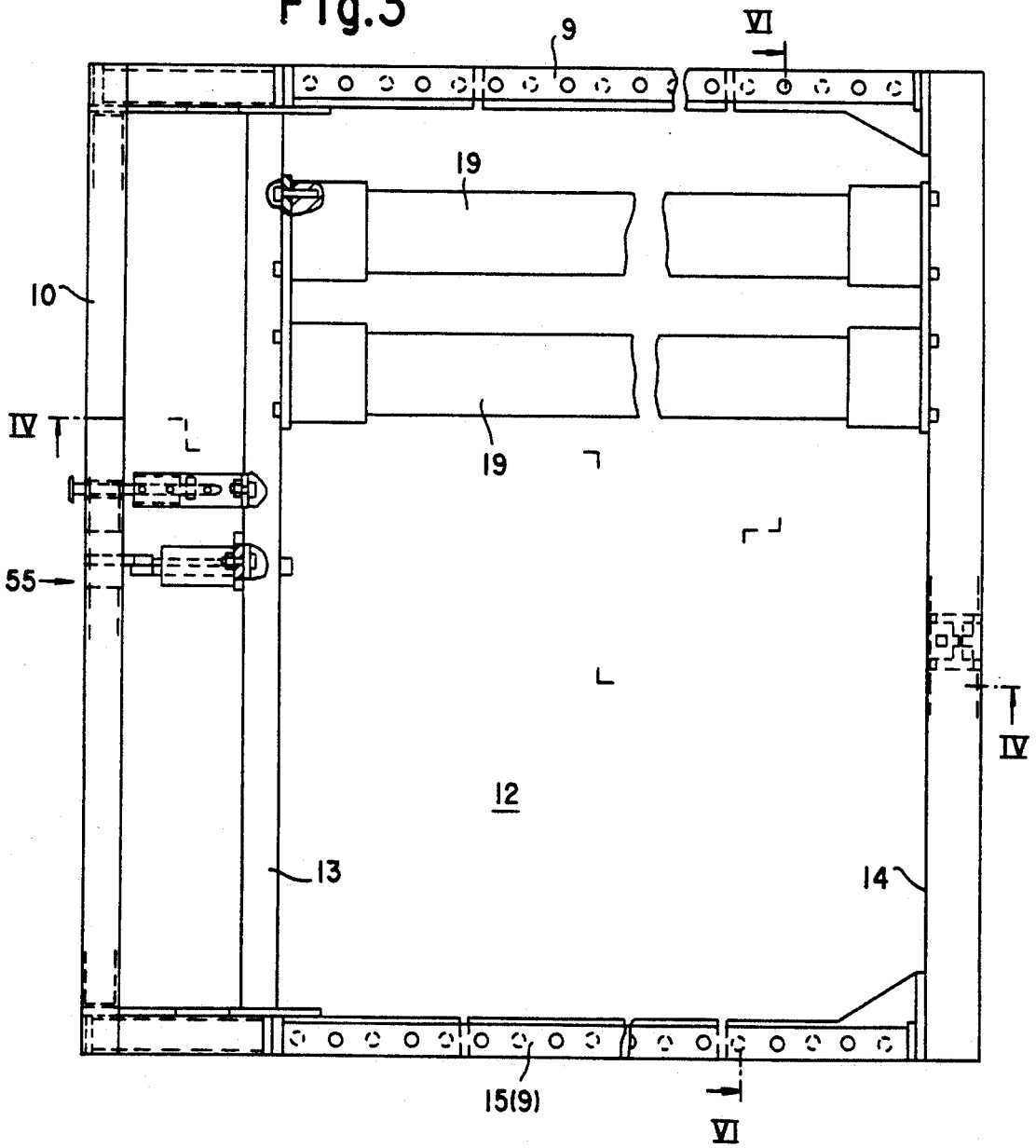

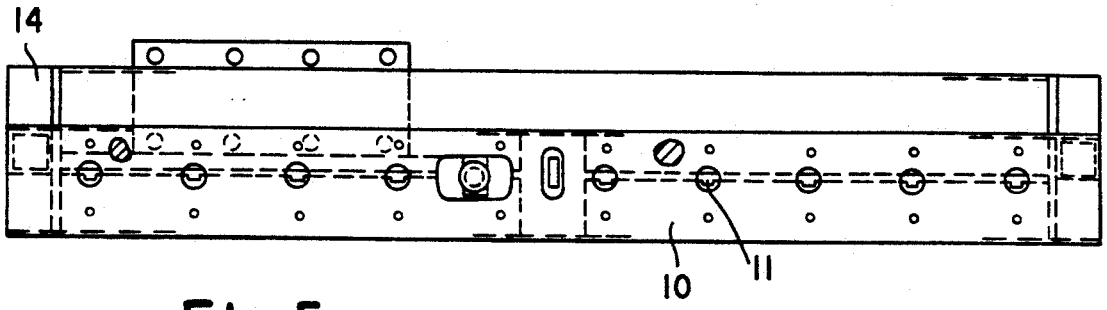
Fig.5
Fig.6
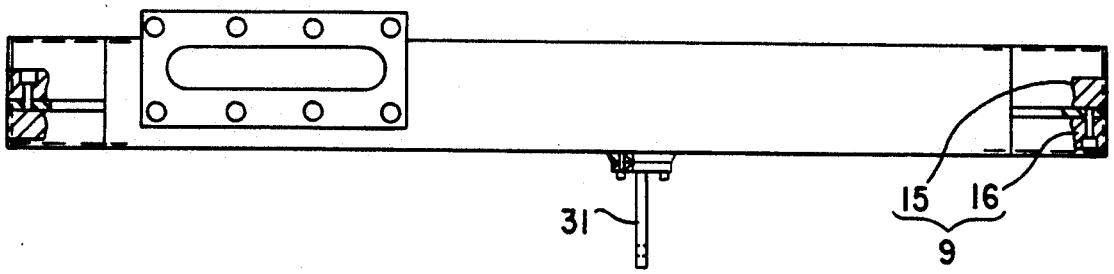

DEVICE FOR UNITING A RESIDUAL PILE OF SHEETS AND A MAIN PILE OF SHEETS

The invention relates to a device for uniting a residual pile of sheets and a main pile of sheets in a pile zone of a sheet feeder to form an aggregate pile, wherein an uppermost sheet of the main pile is brought into contact with a lowermost sheet of the residual pile.

Such a device has become know heretofore, for example, from the Japanese publication Hei 1-321222 (A). The device is described therein as having a rake with mutually parallel lattice or grid bars underpinning the residual pile of sheets during certain phases of the uniting process, and a displacement device for carrying and displacing the rake, the displacement device being constructed so as to displace the rake horizontally in the longitudinal direction of the lattice bars between a first position outside the pile zone and a second position underpinning the residual pile of sheets, inside the pile zone. Moreover, in the heretofore known device of the Japanese publication, the displacement device is carried by a lifting device into a lower position in order to lower the rake and into an upper position in order to raise the rake.

A device of the foregoing general type described in the introduction hereto has further become known from the German Non-prosecuted Patent Publication 39 22 803 A1. In order to lower and raise a rake, the device described in the German publication has a lifting device which includes a horizontal cross-member or traverse which carries the rake, and is aligned transversely with respect to the lattice bars, the cross-member having ends which are guided by means of vertically extending guideways which are provided on a lifting frame or cradle.

A device of the general type mentioned in the introduction hereto has further become known from U.S. Pat. No. 3,180,638, wherein it is described as including, among other things, a compensation device which, by means of a counterweight, reduces the force necessary for raising and lowering the rake, as well as supporting means for the ends of the lattice bars projecting beyond the residual pile of sheets when the rake is in its second position.

Further known heretofore from the Japanese publication Hei 3-9333 (U) is a sheet-feeding device into which a rake is temporarily insertable. A suitable displacement device for the rake is further described therein as being carried by a scaffold erected outside the pile zone, the scaffold being composed of laterally erected frames, each of which is formed of a plurality of supports, and of cross-connectors, which unite the frames at the upper ends thereof to form a gantry which encloses the displacement device.

In a device heretofore known from the Japanese publication Hei 1-321222 (A), a lifting cradle is provided in the form of a scaffold positioned in front of the sheet feeder. The scaffold is supported at its front end on and facing towards the sheet feeder and, at the rear end of the scaffold, the latter has a pair of supports, spaced apart laterally in such a manner that a replenishment pile, which is positioned, in turn, in front of the scaffold and is intended to serve as the main pile in the pile-uniting process, can be moved between and through the supports towards the pile zone in the sheet feeder. In the heretofore known device, the displacement device constructed for horizontally displacing the rake in the longitudinal direction of the lattice bars includes a pair of horizontal guide rails which extend from the front end to the rear end of the scaffold along each side of the scaffold and are guided vertically along the supports at the front and rear ends thereof. These guide rails constitute a track for a carriage drivable thereon and carrying the lattice bars of the rake, and are therefore of such length that, through appropriate movement of the carriage, the lattice bars are able, on the one hand, in certain phases of the uniting process, to completely underpin the residual pile and, on the other hand, to be withdrawn from the pile zone over the entire length thereof. The total length of the scaffold is thus relatively great. Yet, in addition, the freedom of movement of an operator is extensively restricted by the scaffold in a region in front of the sheet feeder. In the heretofore known device of this Japanese publication, this restriction takes into consideration that the path to be traversed by the main pile which is to be united with the residual pile of sheets, a path which is being considerably impeded by the scaffold, is furnished with a track on which it is possible to move a carriage bearing a replenishment pile. Thus, on the one hand, to be sure, the shunting of a replenishment pile into the scaffold and out of it into the pile zone of the sheet feeder is facilitated; however, on the other hand, the accessibility of the region in front of the sheet feeder and accordingly, for example, also the manual removal of a pile-carrying plate, which is removed from the residual pile of sheets during the uniting process, are rendered considerably more difficult.

In the device heretofore known from the German Printed Non-Prosecuted Publication 39 22 803 A1, the lifting device for lowering and raising the rake includes a lifting cradle integrated into a side part of a sheet feeder. In the device heretofore known from this German publication, therefore, the construction of a sheet feeder for non-stop operation calls for far-reaching structural or design modifications to be made in the sheet feeder.

The same necessity would exist likewise with regard to the non-stop device heretofore known from the aforementioned U.S. Pat. No. 3,180,638, which is fully integrated into the sheet feeder.

It is accordingly an object of the invention to provide a device for uniting a residual sheet pile and a main sheet pile which results in non-stop operation of a sheet feeder, the device being as easy and convenient to use as possible.

With the foregoing and other objects in view, there is provided, in accordance with the invention, a device for uniting residual pile of sheets and a main pile of sheets in a pile zone of a sheet feeder to form an aggregate pile wherein an uppermost sheet of the main pile of sheets has been brought into contact with a lowermost sheet of the residual pile of sheets, comprising a rake for underpinning and carrying the residual pile of sheets during given phases of a process for uniting the piles of sheets, the rake comprising mutually parallel, horizontal lattice bars, and a displacement device for carrying and displacing the rake, the displacement device having means for horizontally displacing the rake in longitudinal direction of the lattice bars between a first position outside the pile zone and a second position inside the pile zone, wherein the residual pile of sheets is underpinned by the rake, means disposed in the pile zone for supporting respective ends of the lattice bars projecting beyond the residual pile of sheets, a lifting device carrying the displacement device for lowering the rake into a lower position and for raising the rake into an upper position, the lifting device having a horizontally disposed cross-member arrangement holding the displacement device and being oriented transversely to the lattice bars, a lifting cradle having vertically extending guideways, a first and a second end of the cross-member arrangement being guidable by the guideways, the lifting cradle being constituted by a gantry disposed outside the pile zone, and comprising a pair of columns respectively formed of a hollow section, and a compensation device comprising a respective counterweight dipping into the hollow section.

In accordance with another feature of the invention, the columns are of such height that the displacement device is liftable into an upper position higher than the height of the sheet feeder.

In accordance with a concomitant feature of the invention, the displacement device has a telescopic slide capable of telescoping in the longitudinal direction of the lattice bars.

Because the device according the the invention has a gantry with only two legs as the lifting cradle, during the non-stop operation of a sheet feeder cooperating with such a device, there is no appreciable obstruction to the loading of the sheet feeder with replenishment piles which are supposed to serve as main piles in the uniting process. The extremely compact lifting cradle requires very little positioning space so that, even if replenishment piles are shunted with the aid of a hand-operated elevating truck, no appreciable obstructions have to be taken into consideration. After the lattice bars between the residual pile of sheets and the main pile of sheets have been withdrawn, the rake can be moved with relatively little expenditure of force from a thereby assumed working height into a higher parking position. The fact that the counterweight of the compensation device is guided within the hollow columns of the gantry dispenses with any need to screen off the travel path traversed by the counterweight, a procedure which would otherwise be necessary for reasons of accident prevention, and thus contributes to an extremely compact construction of the device according to the invention. This is, of course, advantageous, for example, with regard to the loading of the sheet feeder with replenishment piles by means of a hand-operated elevating truck, inasmuch as the only obstacle in this regard is having to go around the space taken up by either of the columns.

Other features which are considered as characteristic for the invention are set forth in the appended claims.

Although the invention is illustrated and described herein as embodied in device for uniting a residual pile of sheets and a main pile of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a much-enlarged fragmentary view of FIG. 2 showing a frame removed from the displacement device of FIG. 2.

FIG. 4 is a sectional view of FIG. 3 taken along the line IV—IV in the direction of the arrows;

FIG. 5 is another sectional view of FIG. 3 taken along the line V—V in the direction of the arrows;

FIG. 6 is a further sectional view of FIG. 3 taken along the line VI—VI in the direction of the arrows;

Figure 1:
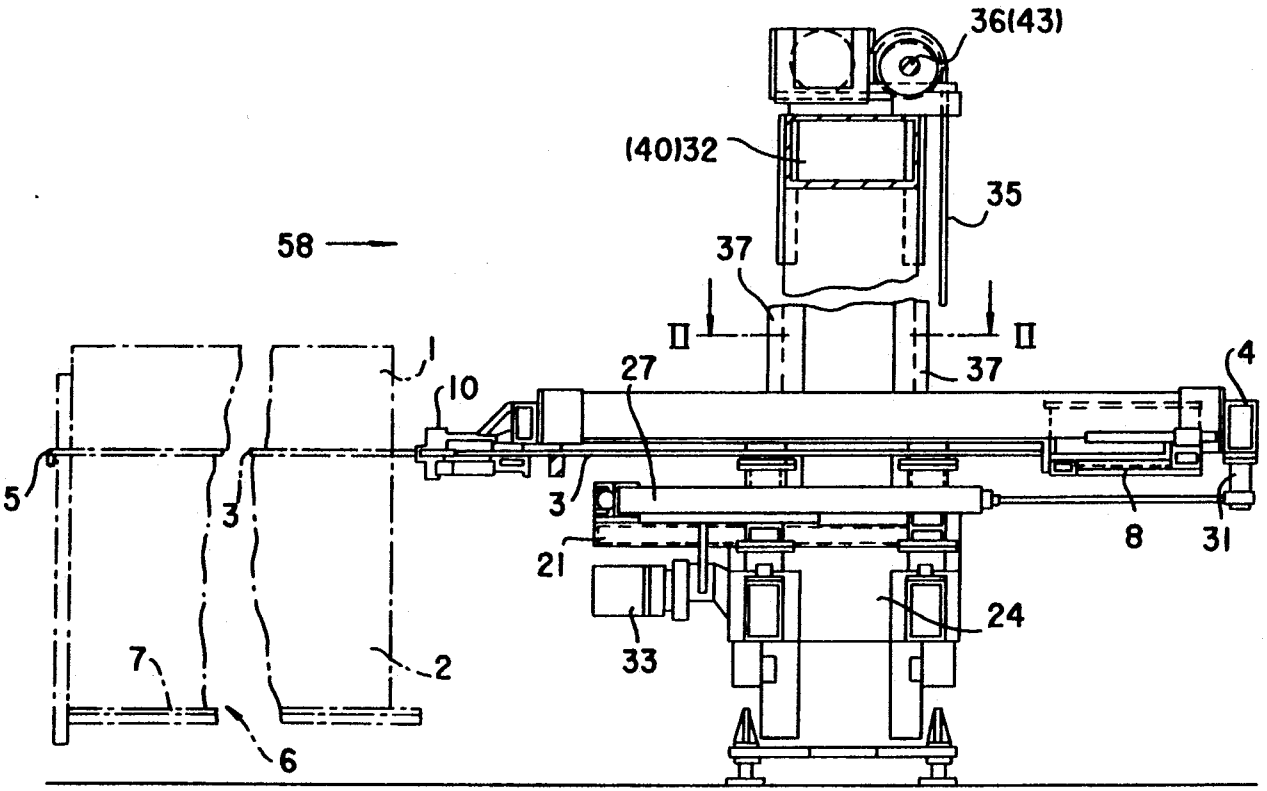
FIG. 1 is a front elevational view of a device for unifying a residual sheet pile and a main sheet pile including a displacement device and its association with a sheet pile arrangement.

Referring now to the drawings and, first, particularly to FIG. 1 thereof, a pile zone of a sheet feeder is shown therein only diagrammatically by representing a residual pile of sheets 1 and a main pile of sheets 2 in phantom in a phase of the pile uniting process wherein the residual pile of sheets 1 is seated with its lowermost sheet on horizontally disposed lattice bars 3 of a displacement device identified as a whole by reference numeral 4 and wherein the main pile of sheets 2 is in contact from below, with the uppermost sheet thereof against the lattice bars 3, the lattice bars 3 being in the position shown in phantom, which is offset in the longitudinal direction of the lattice bars 3 with respect to the position thereof shown in solid lines. The free ends of the lattice bars 3 projecting beyond a side surface of the pile arrangement are supported in a conventional manner by means of an auxiliary traverse or cross-member 5, shown in cross section in FIG. 1.

The main pile 2 is seated with its lowermost sheet on a pile-carrying plate 6. In a sheet feeder of a printing press, a pile of sheets seated on such a pile-carrying plate is raised, during a production run, by means of conventional lifting mechanisms to the same extent as the height of the pile of sheets decreases, until the pile finally becomes a residual pile of sheets. If the displacement device 4, therefore, is installed in conjunction with a sheet feeder of a printing press then, prior to being united with the main pile 2, the residual pile of sheets is initially seated, likewise, with its lowermost sheet on a pile-carrying plate 6 until the pile-carrying plate 6 is removed in a conventional manner by being lowered by the aforementioned lifting mechanisms after the residual pile of sheets 1 has been underpinned by means of the lattice bars 3. Mutually parallel grooves 7 are formed, in a conventional manner, on the horizontally aligned upper side of the pile-carrying plate 6. A group of the mutually parallel lattice bars 3 is assembled to form a rake 8, the cross sections of the lattice bars 3 and of the grooves 7 being so coordinated that the lattice bars 3 can be inserted, in the longitudinal direction thereof, into the grooves 7 so that, in a phase of the uniting process, the residual pile of sheets 1 is underpinned by the lattice bars 3.

In order to displace the lattice bars 3 in the longitudinal direction thereof, guide rails 9 on which the rake 8 is displaceably held are provided for this purpose in the displacement device 4.

The phase of the uniting process shown in FIG. 1, with a view of the mutual positions of the residual pile 1, the main pile 2 and the lattice bars 3 enclosed therebetween, is followed, in a final phase of the uniting process, by the removal of the lattice bars 3 from the illustrated pile arrangement, in a removal direction towards the right-hand side of FIG. 1 In order to prevent sheets which are in the vicinity of the lattice bars 3 from being displaced likewise in the removal direction, a conventional stop rail 10 is provided which extend transversely to the longitudinal direction of the lattice bars and is displaceable in the longitudinal direction of the lattice bars 3, the stop rail 10 being formed with penetrations 11 discernible in FIGS. 4 and 5 for affording passage of the lattice bars 3 through the stop rail 10.

Figure 2:
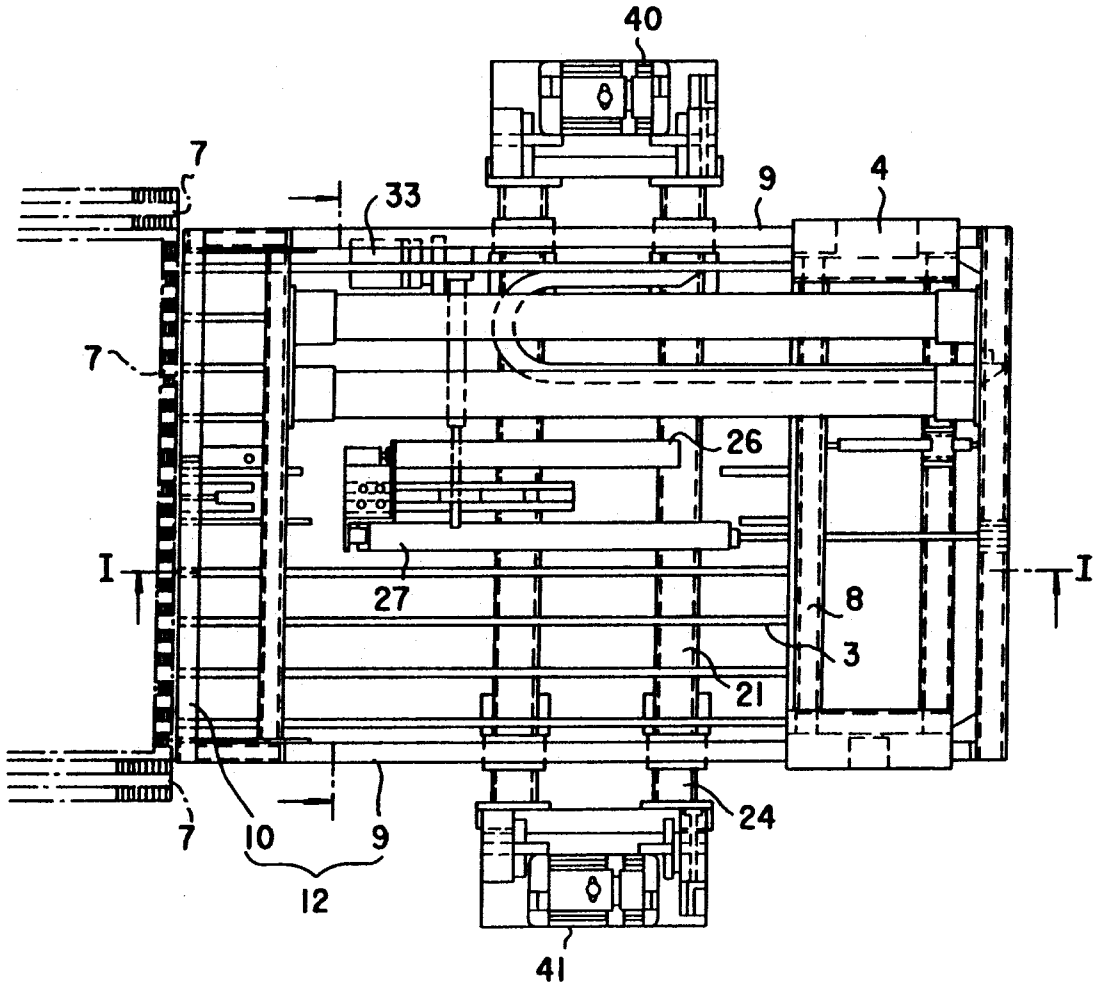
FIG. 2 is an enlarged cross-sectional view of FIG. 1 taken along the line II—II in the direction of the arrows.

As is apparent from FIG. 2, the guide rails 9, respectively, form a side part of a frame 12, and the stop rail 10 forms an end or front leg of the frame 12.

The frame 12, which is shown in FIG. 3 removed from the displacement device 4 and in a position corresponding to the position thereof shown in FIG. 2, is additionally stiffened by means of a first cross-strut 13 at a front end (situated at the left-hand side of FIG. 3) and by means of a second cross-strut 14 at a rear end of the guide rail 9 (situated at the right-hand side of FIG. 3).

Figure 7:
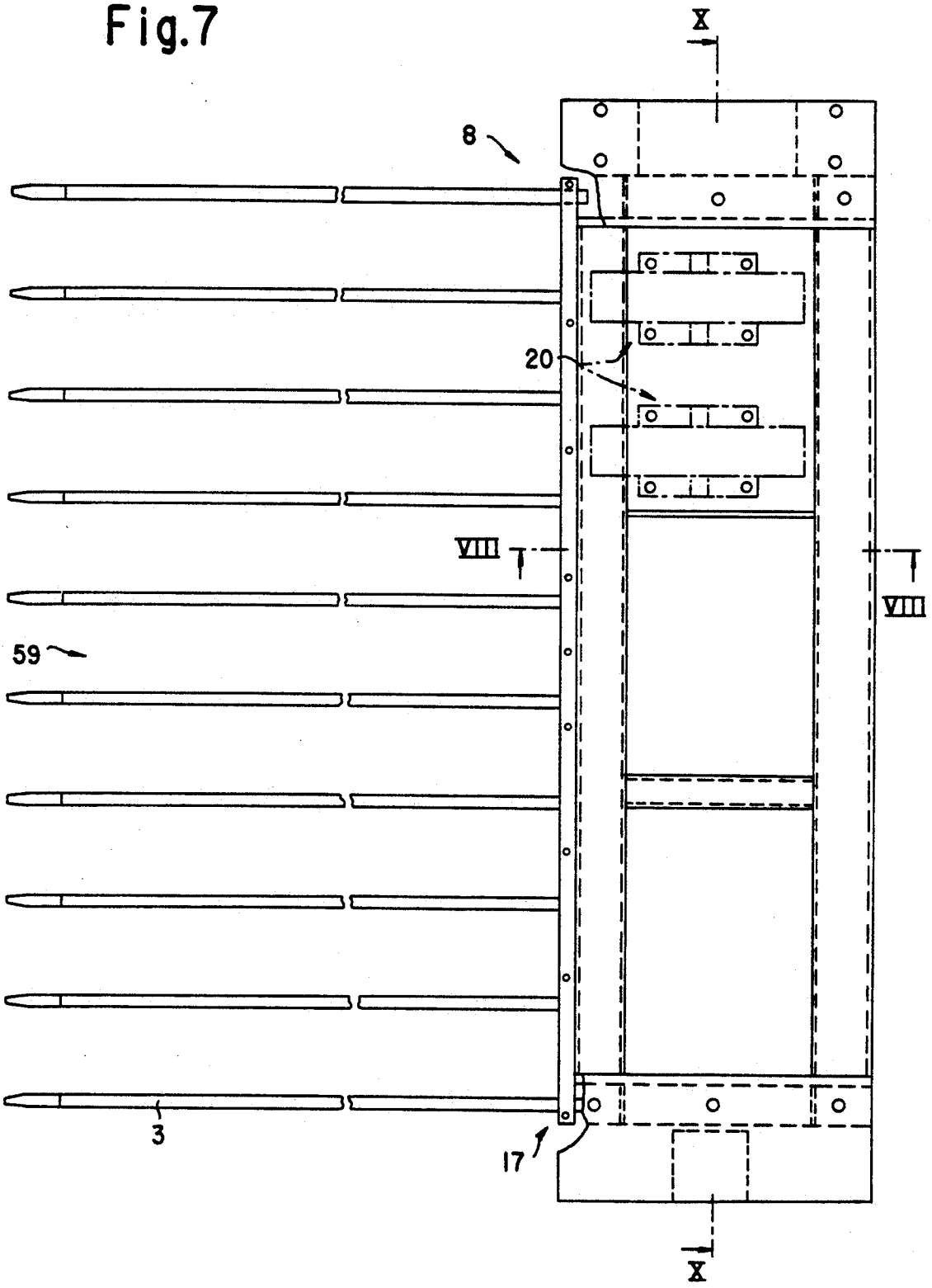
FIG. 7 is a top plan view of a rake, removed from the displacement device of FIG. 2.
Figure 8:
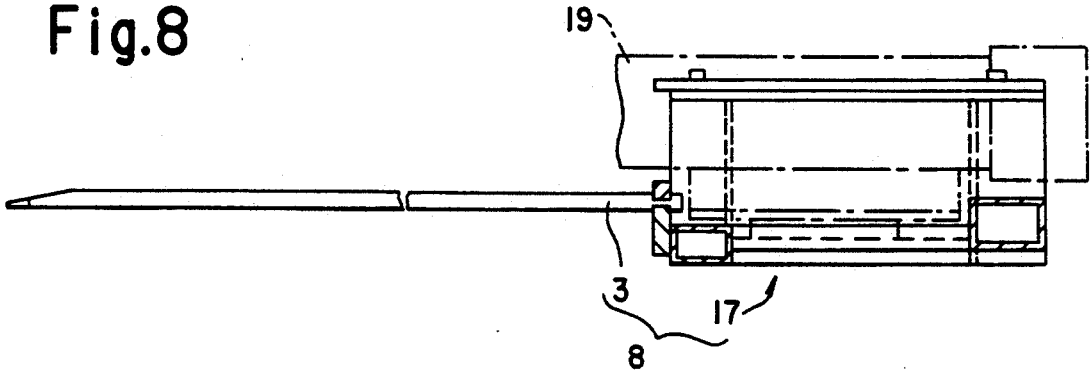
FIG. 8 is a cross-sectional view of FIG. 7 taken along the line VIII—VIII in the direction of the arrows.
Figure 9:
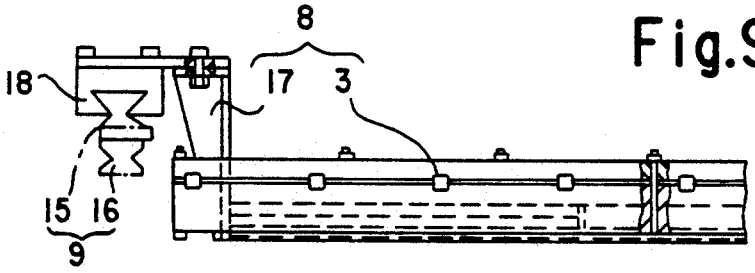
FIG. 9 is another fragmentary cross-sectional view of FIG. 7 taken along line IX—IX in the direction of the arrows.

As can be seen from FIG. 6, each guide rail 9 is assembled of an upper guide bar 15 and of a lower guide bar 16, the upper guide bar 15 serving as a straight guide for the rake 8, which is shown in FIG. 7 removed from the displacement device 4 and in a position corresponding to the position thereof in FIG. 2. The rake 8 is formed by a bridge 17 in which the lattice bars 3 are clamped by one of the ends thereof, respectively, as can be seen most clearly in FIG. 8. The bridge 17 extends transversely to the longitudinal direction of the lattice bars 3 and has bridge bearings in the form of straight guide sections or profiles 18, each of which embraces an upper guide bar 15 of one of the guide rails 9. FIG. 9 shows how the straight guide sections 18 are connected to an upper guide bar 15, with the upper and lower guide bars 15 and 16 each being represented in phantom. The guide rails 9 and the lattice bars 3 extend parallel to one another, so that the rake 8 is supported in a manner that it is displaceable with respect to the frame 12 in the longitudinal direction of the lattice bars 3.

Figure 10:
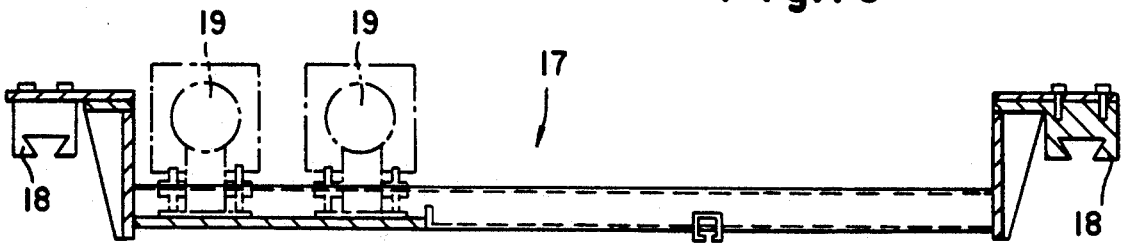
FIG. 10 is a further sectional view of FIG. 7 taken along the line X—X in the direction of the arrows.

The illustrated embodiment provides for an independent displacement of the rake 8 with respect to the frame 12. With regard thereto, band cylinders 19 are disposed between the first and the second cross-struts 13 and 14 of the frame 12 and oriented parallel to the guide rails 9, the band cylinders 19, as indicated in phantom in FIG. 10, having bands which are connected to the bridge 17 of the rake 8. In FIG. 7, corresponding connecting means 20 for connecting the bands of the band cylinders 19 to the bridge 17 are shown diagrammatically and in phantom.

The frame 12, in turn, is mounted so that it is displaceable in the longitudinal direction of the lattice bars 3 and in the horizontal transverse to the longitudinal direction of the lattice bars 3. In the embodiment of FIGS. 1 and 2, the displacement device is equipped with a cross-slide 21 for this purpose.

Figure 11:
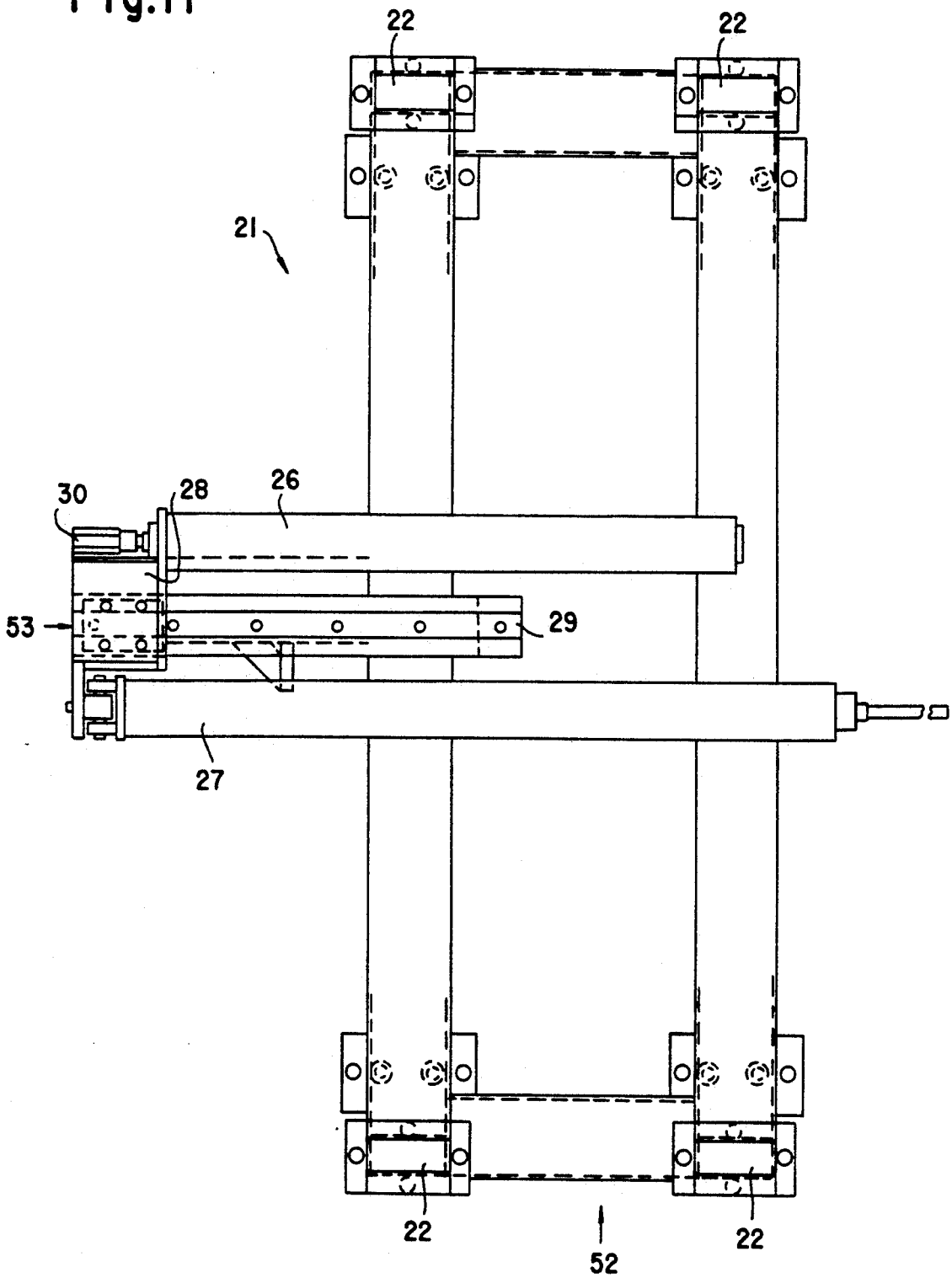
FIG. 11 is a top plan view of a cross-slide removed from the device of FIG. 2.

The cross-slide 21, which is illustrated in FIG. 11 removed from the displacement device 4 and in a position corresponding to the position thereof shown in FIG. 2, extends transversely to the lattice bars 3 from a guide rail 9 on a first longitudinal side of the frame 12 to the opposite guide rail 9 on a second longitudinal side of the frame 12, and has straight guide sections 22 corresponding to the straight guide sections 18 (FIGS. 9 and 10) provided on the rake 8. These straight guide sections 22 embrace a respective lower guide bar 16 of a respective guide rail 9. Thus, the frame 12, with respect to the cross-slide 21, and the rake 8, with respect to the frame 12, are displaceable in the longitudinal direction of the lattice bars 3. In summation, accordingly, a telescopic slide is provided which displaces the lattice bars 3 in the longitudinal direction thereof.

Figure 12:
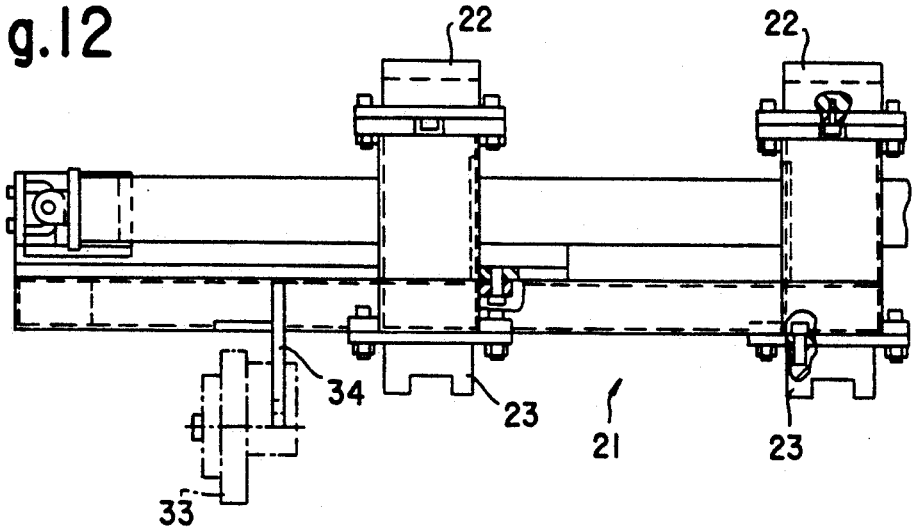
FIG. 12 is a side elevational view of the cross-slide as seen in the direction of arrow 52 in FIG. 11.
Figure 13:
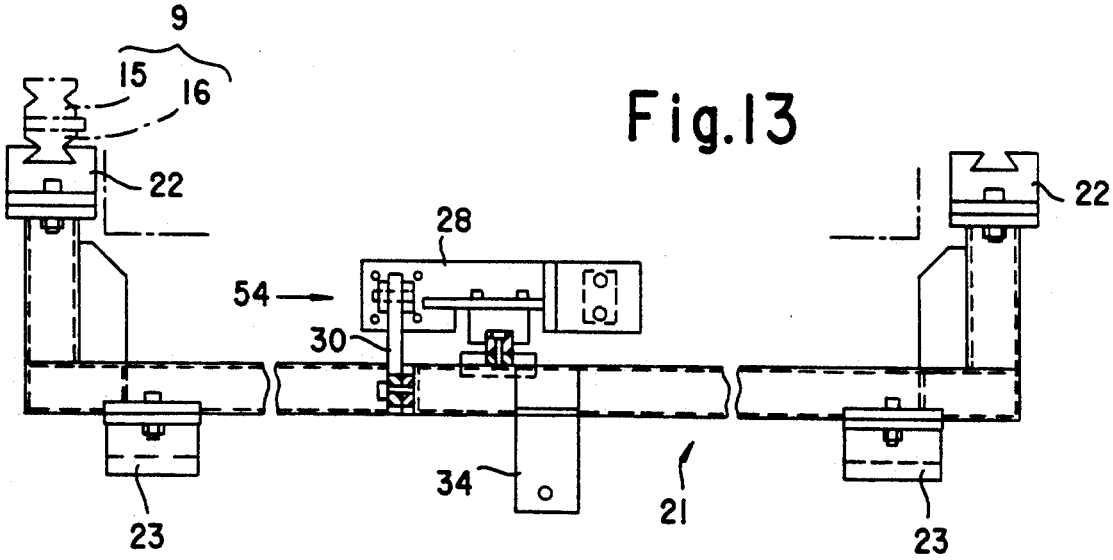
FIG. 13 is another side elevational view of the cross-slide as seen in the direction of arrow 53 in FIG. 11.

The cross-slide 21 is equipped with other straight guide sections 23 oriented transversely with respect to the lattice bars 3 (note FIGS. 12 and 13). The straight guide sections 23 will be discussed hereinafter in greater detail.

Figure 14:
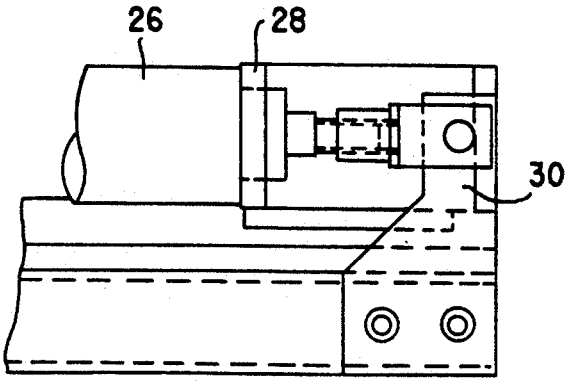
FIG. 14 is an enlarged fragmentary elevational view in the direction of arrow 54 in FIG. 13.

The illustrated embodiment of the invention provides for the independent displacement of the frame 1 with respect to the cross-slide 21. In this regard, a piston-cylinder arrangement is provided which includes a first cylinder 26 and a second cylinder 27 and which acts between the cross-slide 21, on the one hand, and the frame 12, on the other hand. The first cylinder 26 is flanged onto a guide head 28, which is guided by means of a slideway 29 oriented in the longitudinal direction of the lattice bars 3 and attached to the cross-slide 21, while the piston rod of the first cylinder 26 is swivel-mounted on a strap 30 attached to the cross-slide 21 (see FIG. 11, 13 and 14). The second cylinder 27 is articulatingly mounted at its one end on the guide head 28, while the end of the piston rod of the second cylinder 27 facing away from the one end is connected in an articulating manner to a further strap 31 (note FIG. 1, for example), which, in turn, is attached to the frame 12.

A lifting device carrying the displacement device 4 is provided in order to lower the displacement device 4 and thus the rake 8 into a lower position and to raise them into an upper position. The lifting device has a horizontal cross-member arrangement 24, which is oriented transversely to the lattice bars 3.

Figure 15:
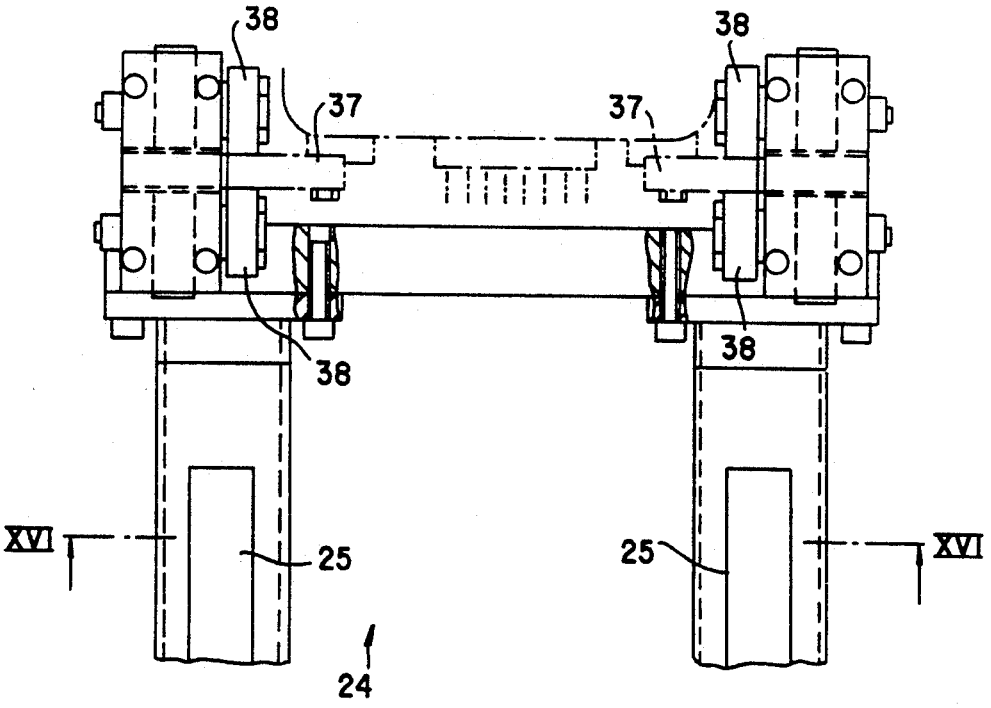
FIG. 15 is a much-enlarged fragmentary view of FIG. 2 showing a cross-member arrangement thereof removed from the displacement device.

The cross-member arrangement 24, shown in FIG. 15 removed from the lifting device and in a position corresponding to the position thereof shown in FIG. 2, is provided in the illustrated embodiment with horizontally extending straight guide tracks 25 oriented transversely to the lattice bars 3 and being in engagement with the aforementioned straight guide sections 23 provided on the cross-slide 21. Consequently, the cross-slide 21 is horizontally displaceable transversely to the longitudinal direction of the lattice bars 3.

The illustrated embodiment of the device according to the invention further provides for the independent displacement of the cross-slide 21 with respect to the cross-member arrangement 24. For this purpose, a linear servo-drive 33 is mounted on the cross-member arrangement 24 and a pushrod of the linear servo-drive 33 is articulatingly connected to another strap 34 which is fastened to the cross-slide 21.

Figure 16:
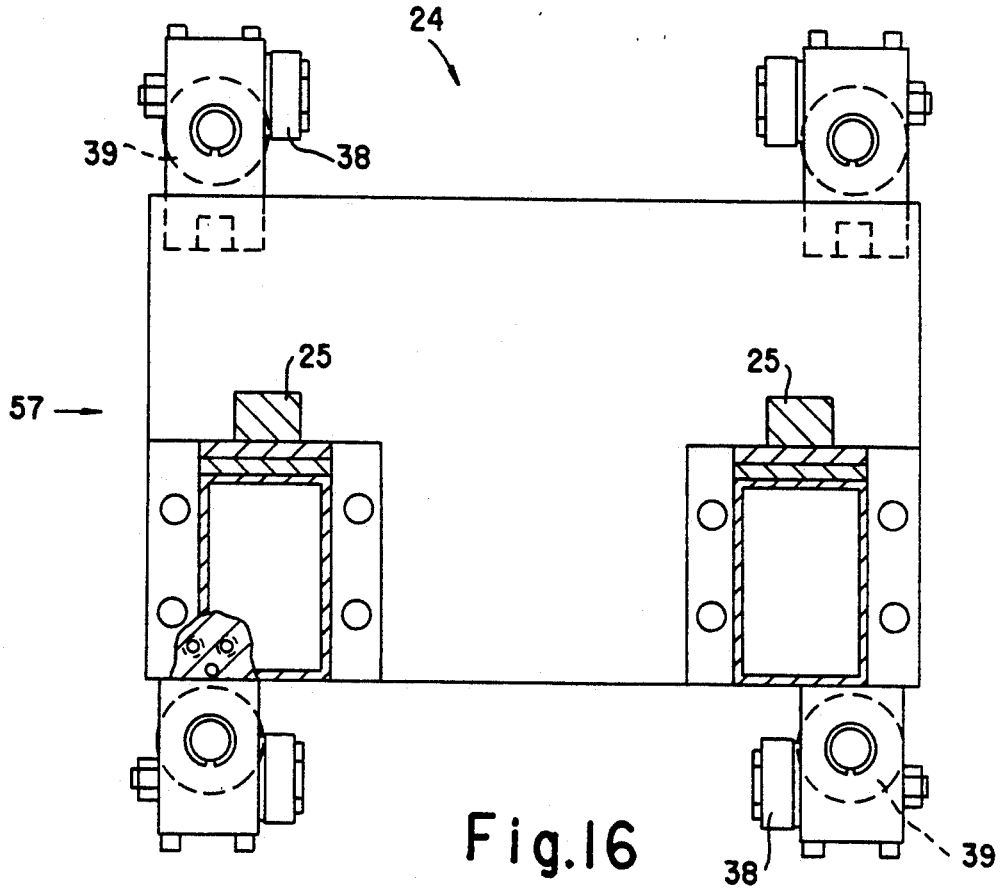
FIG. 16 is a sectional view of FIG. 15 taken along the line XVI—XVI in the direction of the arrows.
Figure 17:
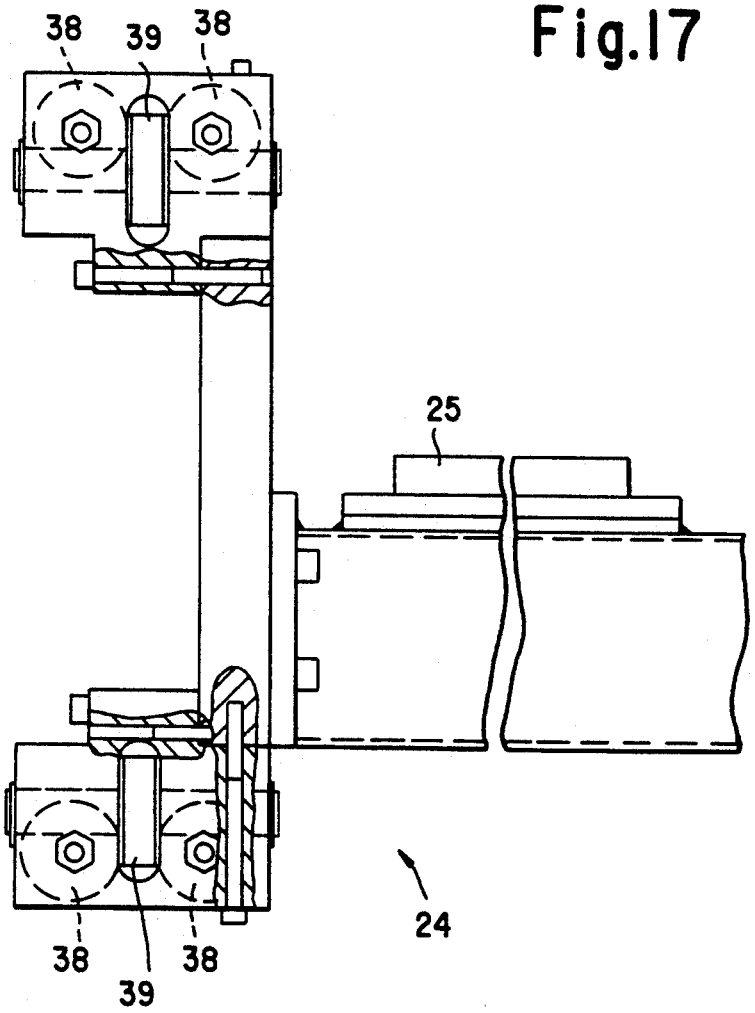
FIG. 17 is a side elevational view of the cross-member arrangement as seen in the direction of arrow 57 in FIG. 16.
Figure 18:
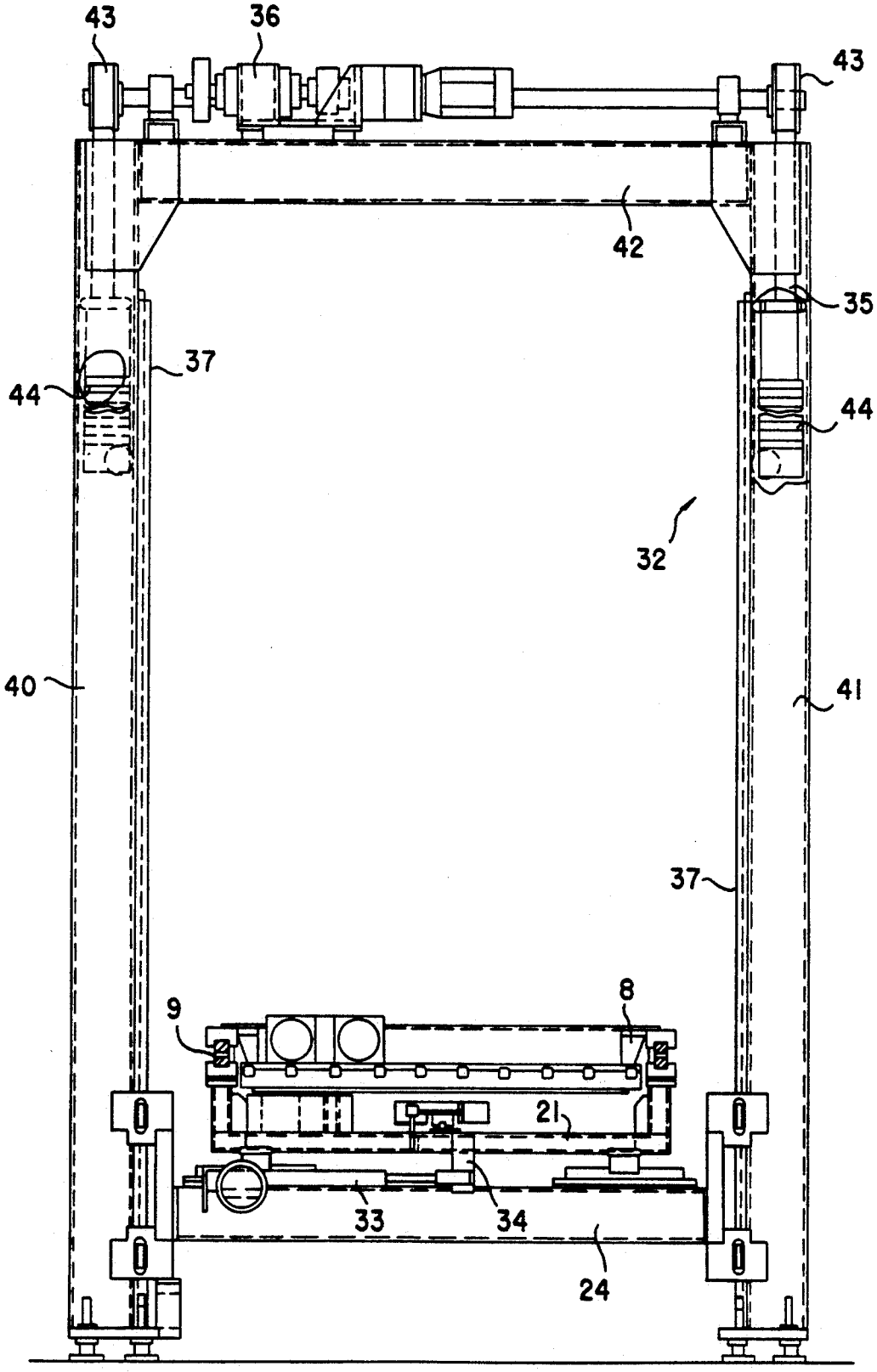
FIG. 18 is an elevational view of the device according to the invention as seen the the direction of arrow 58 in FIG. 1.

In FIGS. 15, 16 and 17, there is shown one end of the cross-member arrangement 24, which can be seen in its entirety in FIG. 18. The cross-member arrangement 24 is connected, in a manner not shown in greater detail, through the intermediary of traction means 35 attached thereto, such as a chain or a toothed belt, to a lifting drive 36 (note FIGS. 1 and 18) and is vertically movable along a lifting cradle 32. For this purpose, each end of the cross-member arrangement 24 is guided on vertically extending guideways 37 provided on a lifting cradle 32.

In the illustrated embodiment, the guideways 37 are in the form of rectangular section bars, the cross sections of which are represented in phantom in FIG. 15.

Respective ends of the cross-member arrangement 24 are each provided with rollers 38 and 39, which roll on the guideways 37 and which are so disposed that they fix the cross-member arrangement 24 transversely with respect to the longitudinal direction of the guideways 37.

The lifting cradle 32 is of self-supporting construction and, as can be seen most clearly in FIG. 1, is erected outside the pile zone, which is represented schematically in FIG. 1 by the residual pile 1 and the main pile 2 shown in phantom. The lifting cradle 32 is composed of a first column 40, a second column 41 and a yoke 42 (FIG. 18), the yoke 42 connecting the upper ends of the columns 40 and 41. The lifting cradle 32 thus forms a two-legged gantry. The respective columns 40 and 41 are formed of a hollow section or profile.

In the illustrated embodiment of the device according to the invention, the traction means 35 provided for raising and lowering the cross-member arrangement 24 are represented by toothed belts. Guide wheels 43 having suitable toothing to match the toothed belts are held on the yoke 42 and are each surrounded by a toothed belt, a first side of each toothed belt bearing the cross-member arrangement 24 and a second side of each toothed belt bearing a counterweight 44, which dips into the hollow section of the respective column 40, 41.

Figure 19:
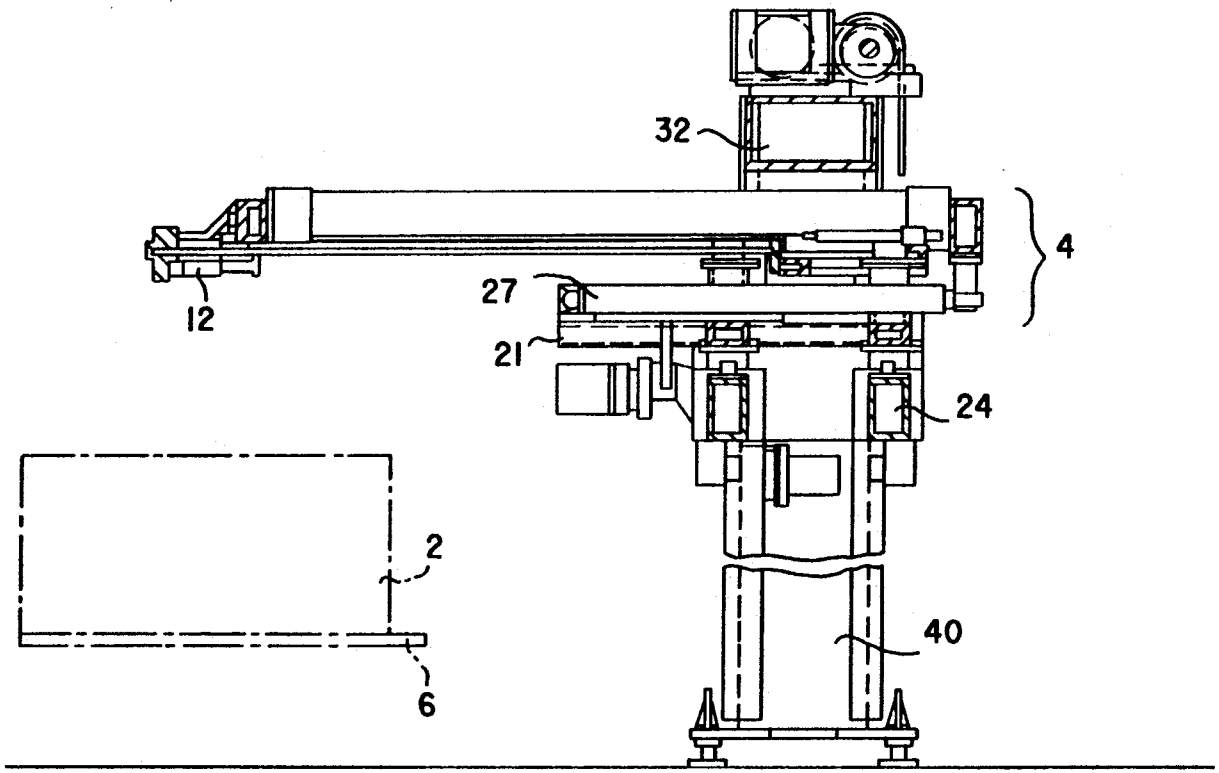
FIG. 19 is a view similar to that of FIG. 1 showing the displacement device in another operating phase thereof, i.e. in a parking position.

When the displacement device 4 is in the position shown in FIG. 19, it is in a so-called parking position wherein at least the frame 12, carrying the rake 8, is at a height which is above that of the sheet feeder, represented in FIG. 19 by the main pile 2. The two columns 40 and 41 are provided at a suitable height for this purpose.

In the aforementioned parking position, the frame 12 is also displaced so far towards the sheet feeder that the assumed area of the ground plan of a front part, i.e., the left-hand part in FIG. 19, of the frame 12 lies within the assumed area of the ground plan of the sheet feeder. A rear end, i.e., the right-hand end in FIG. 19, of the frame 12 has moved so close to the lifting cradle 32 that the frame 12, at the end thereof facing away from the sheet feeder, and thus also the displacement device 4, at the corresponding end of the latter, project only slightly beyond the lifting cradle 32. Access to the sheet feeder is thus particularly good in this case.

In the aforedescribed parking position, moreover, both piston rods of the piston-cylinder unit formed by the first cylinder 26 and the second cylinder 27 (note also FIG. 11) are fully retracted.

We claim:

1. Device for uniting a residual pile of sheets and a main pile of sheets in a pile zone of a sheet feeder to form an aggregate pile wherein an uppermost sheet of the main pile of sheets has been brought into contact with a lowermost sheet of the residual pile of sheets, comprising a rake for underpinning and carrying the residual pile of sheets during given phases of a process for uniting the piles of sheets, said rake comprising mutually parallel, horizontal lattice bars, a displacement device for carrying and displacing said rake, said displacement device having means for horizontally displacing said rake in longitudinal direction of said lattice bars between a first position outside the pile zone and a second position inside the pile zone, wherein the residual pile of sheets is underpinned by said rake, means disposed in the pile zone for supporting respective ends of said lattice bars projecting beyond the residual pile of sheets, a lifting device carrying said displacement device for lowering said rake into a lower position and for raising said rake into an upper position, said lifting device having a horizontally disposed cross-member arrangement holding said displacement device and being oriented transversely to said lattice bars, a lifting cradle having vertically extending guideways, a first and a second end of said cross-member arrangement being guidable by said guideways, said lifting cradle being constituted by a gantry disposed outside the pile zone, and comprising a pair of columns respectively formed of a hollow section, and a compensation device comprising a respective counterweight dipping into said hollow section.

2. Device according to claim 1, wherein said columns are of such height that said displacement device is liftable into an upper position higher than the height of the sheet feeder.

3. Device according to claim 1, wherein said displacement device has a telescopic slide capable of telescoping in the longitudinal direction of said lattice bars.

* * * * *